US005822951A

United States Patent [19]

Rosik

[11] Patent Number: 5,822,951

[45] Date of Patent: Oct. 20, 1998

[54] APPARATUS AND METHOD FOR SAMPLING GAS IN PRODUCT PACKAGES

[75] Inventor: Richard Rosik, Minneapolis, Minn.

[73] Assignee: Modern Controls, Inc., Minneapolis, Minn.

[21] Appl. No.: 965,380

[22] Filed: Nov. 6, 1997

[51] Int. Cl.[6] ..... B65B 31/02; B65B 57/00

[52] U.S. Cl. ..... 53/432; 53/510; 53/507; 53/508; 53/167; 73/863.02; 73/863.81

[58] Field of Search ..... 53/432, 510, 511, 53/512, 507, 508, 167, 86, 89, 97, 101; 73/863.02, 863.81, 863.83, 864.81

[56] References Cited

U.S. PATENT DOCUMENTS

| | | | |
|---|---|---|---|
| 2,406,192 | 1/1946 | Cantrell | 73/863.02 |
| 3,117,441 | 1/1964 | Zimmerman | 53/508 |
| 3,209,598 | 10/1965 | Anderson et al. . | |
| 3,661,528 | 5/1972 | Falk . | |
| 3,681,997 | 8/1972 | Allen et al. . | |
| 4,997,664 | 3/1991 | Williams | 53/432 X |
| 5,363,707 | 11/1994 | Augenblick et al. | 73/863.81 X |
| 5,379,654 | 1/1995 | Carvajal et al. . | |
| 5,528,880 | 6/1996 | Landolt | 53/432 |

*Primary Examiner*—Linda Johnson
*Attorney, Agent, or Firm*—Palmatier, Sjoquist, Voigt & Christensen, P.A.

[57] ABSTRACT

An automated gas sampling system for connection into an industrial packaging line, wherein packaged products are sealed in a product chamber. Apparatus as provided for obtaining a gas sample from inside the product package and for transferring the sample to a gas analyzer to record gas content during the operation of the product packaging line.

12 Claims, 4 Drawing Sheets

APPARATUS AND METHOD FOR SAMPLING GAS IN PRODUCT PACKAGES

The present invention relates to an apparatus and method for obtaining gas samples from the interior of product packages at the time the package is sealed during the manufacturing process. More particularly, the invention relates to an apparatus and method for automatically sampling gas concentrations in a random or regular sequence, in a continuous and intermittently moving product packaging line.

BACKGROUND OF THE INVENTION

Many products, particularly food products, are hermetically sealed during the packaging process to retain product freshness and to extend the shelf life of the product. Typically, the product package is purged of oxidizing gases, usually oxygen, and is filled with an inert gas such as nitrogen at the stage of the manufacturing process where a film seal is applied over the package. Although it is impractical to remove all of the oxygen concentration from within the package, it is desirable to remove as much as possible for oxygen will contribute to the chemical reactions which degrade the quality and shelf life of the food product contained within the package. It is difficult to sample the gas concentration from within the package after the product has been completely sealed for this requires some sort of device which will penetrate the package. The penetration device, when removed, will provide a leakage path for oxygen to enter the package after the package has been sealed.

It is well known that films and other types of packaging materials do not provide a complete barrier to oxygen permeation into the package; and therefore, the shelf life of such products is inherently limited. However, if the package can be purged of oxygen by negative pressure or slightly positively pressurized with an inert gas, the gas penetration into the product may be delayed.

It is desirable to measure the quality of the gas purging process more or less continuously during the packaging of products so that an alert may be sounded if the quantities of oxygen and other contaminating gas contained within the package begin to increase as a result of some change in the manufacturing setup. An early alarm will permit changes to be made to the manufacturing setup and will minimize the number of potentially defective product packages which might be shipped to the marketplace.

A particular problem arises when the measuring process is attempted in conjunction with a continuously moving product packaging line. The packaging line is moved at a fairly rapid rate, typically 30 packages per minute, in order to increase the speed and efficiency of packaging, but it is difficult to sample packaging gases at the rate at which the packages move along the line. It is therefore necessary to provide a gas-sampling apparatus capable of retrieving a gas sample from the package and performing a gas measurement while the package is sealed in the packaging machine, and before the next package is moved into the packaging machine. The measurement device requires about two seconds to make an accurate measurement, and typically requires about 5 cubic centimeters (cc) of gas for this measurement. Therefore, the measurement device can function to measure only every second or third package at best. To accomplish even this operation, the gas flow path must be relatively unimpeded and the volume of gas transported to the measuring device must be as small as can reasonably processed with accuracy.

It is a principal object of the present invention to provide an apparatus and method for on-line sampling of gas concentrations in product packages.

It is another object and advantage of the present invention to provide a gas sampling apparatus and a method for implementing the apparatus to permit sampling of the gas content in a product package at the instant the package is sealed.

It is yet another object and advantage of the present invention to provide a gas sampling apparatus which is positioned directly in the product manufacturing line and which does not inhibit or slow down the manufacturing process.

Other objects and advantages will become apparent from the following specification and claims.

SUMMARY OF THE INVENTION

A packaging machine product chamber has a passageway therein which is connected to a sample valve. The sample valve is connected to a sample cylinder which forms a part of an air cylinder which is mechanically linked to a second double-actuating air cylinder which is controlled by a solenoid valve. The solenoid valve is actuated to cause a piston in the sample cylinder to retract, thereby creating a sample chamber to receive a gas sample from the packaging machine product chamber. The product chamber sample valve is then closed and an exhaust valve is opened, connecting the sample chamber to a gas analyzer. The solenoid valve is again actuated to move the double-acting cylinder forward and thereby to force the gas sample in the sample chamber into the gas analyzer for measurement of the quantity of gas of a particular type which had been retrieved from the product chamber. The method of the invention comprises the sequence of steps required for initially purging the product chamber, withdrawing a predetermined volume sample of gas from the product chamber, and conveying the predetermined sample into the gas analyzer. The valve ports and gas flow paths are designed for unimpeded gas flow, and the gas sample chamber volume is selected, relative to other passageway and chamber volumes, to capture a sufficient gas sample for accurate and speedy measurement. The measurement process samples about every second or third package for the test measurements it makes.

DESCRIPTION OF THE PREFERRED EMBODIMENT

Figure 1:
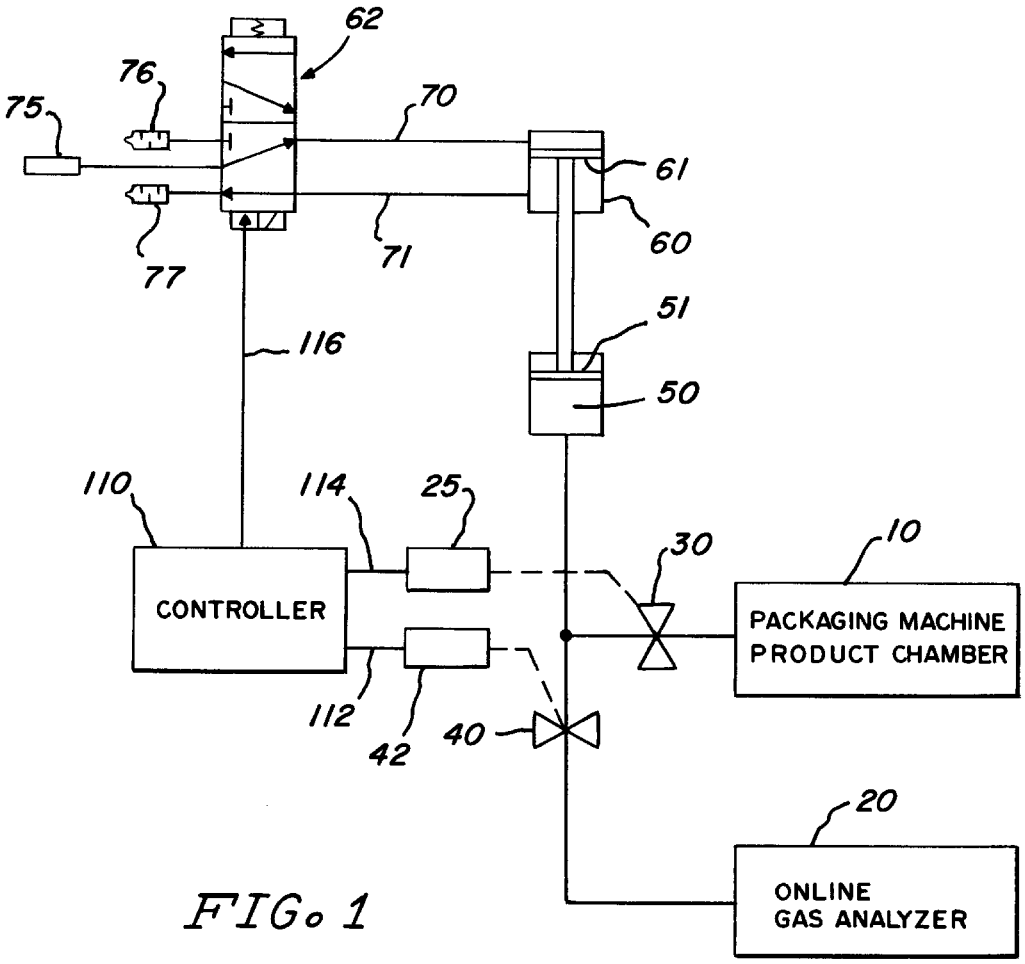
FIG. 1 shows a diagram of the gas sampling portion of the invention.

Referring first to FIG. 1, a packaging machine product chamber is shown at 10. Product chamber 10 is typically a part of a commercially-available machine which is designed for automating the packaging process of a particular product. One such example of a machine of this type is manufactured by Mahaffy & Harder Engineering, but the invention may be applied to most types of commercially available packaging machines. An on-line gas analyzer is shown at 20. Gas analyzer 20 may be any of a number of commercially available products, as for example, a family of on-line gas analyzers manufactured by the assignee of the present invention under the trademark designation "GSA." The "GSA 700" is an on-line analyzer for measuring oxygen, utilizing a zirconium oxide sensor; the "GSA 800" is an on-line analyzer for carbon dioxide, utilizing an infrared "IR" sensor; the "GSA 900" is an on-line gas analyzer utilizing both a zirconium oxide oxygen sensor and an IR carbon dioxide sensor. The principles of operating such on-line gas analyzers involve passing a flow of the unknown gas through the analyzer, wherein the measured gas content causes the generation of a small voltage, and the voltage is monitored to provide a measure of the particular content of the gas flowing through the analyzer. The gas analyzer requires about 5 cc.'s of gas and about two seconds of time to produce an accurate measurement.

A sample chamber 50 is connected to the product chamber of the packaging machine via a sampling valve 30. Sample chamber 50 is also connected to the on-line gas analyzer 20 via an exhaust valve 40. Sample chamber 50 includes a reciprocable piston 51 which is mechanically linked to a drive piston 61 in a double-actuating cylinder 60. Piston 61 is actuated in either of two directions by air pressure applied to air lines 70 and 71. The pressure in air lines 70 and 71 is controlled by solenoid valve 62 which may be actuated by electrical signal over line 116 from controller 110. A source of pressurized air 75 is connected to solenoid valve 62, as are exhaust outlets 76 and 77. In the solenoid valve position shown in FIG. 1, pressurized air from air source 75 is applied to air line 70, and air line 71 is connected to exhaust 77. This connection will cause the piston 61 to move downwardly as shown in FIG. 1 and will correspondingly move piston 51 in sample chamber 50 downwardly. If solenoid valve 62 is actuated to its second operative position, pressurized air from air source 75 is connected to air line 71 and exhaust 76 is connected to air line 70. This causes piston 61 to move upwardly and correspondingly moves piston 51 in sample chamber 50 upwardly. The upward position of piston 51 in sample chamber 50 corresponds to the "sample" mode of operation, which would occur in coincidence with the opening of sample valve 30 and the closing of exhaust valve 40. The downward movement of piston 51 in sample chamber 50 corresponds to the "test" mode of operation, and would occur in coincidence with the closing of sample valve 30 and the opening of exhaust valve 40. In the "sample" mode of operation, gas from the product chamber 10 is passed into sample chamber 50, and in the "test" mode of operation the gas contained within sample chamber 50 is forced into on-line gas analyzer 20.

A packaging machine controller 110 generates the control signals required for operation of the invention. The packaging machine controller is normally a part of the overall packaging machine; the software which controls the operation of controller 110 is typically prepared to cause the controller to generate the operation and control signals described herein. The software preparations are well within the skill of the people who would ordinarily write computer programs. Packaging machine controller 110 may be a commercially-available general purpose digital computer, properly programmed, so as to energize the various electrical signal lines connecting it to solenoids and solenoid valves as described herein. For example, exhaust solenoid 42 is actuated by electrical signals over line 112, and exhaust valve 40 is controlled by solenoid 42. In the actuated position, exhaust valve 40 couples the sample chamber 50 to the on-line gas analyzer 20. Packaging machine controller 110 is connected to solenoid 35 via a line 114. When solenoid 35 is actuated by controller 110, it causes sample valve 30 to close. Packaging machine controller 110 is also connected to solenoid valve 62 via line 116. The operation of solenoid valve 62 has been described previously herein.

Figure 2:
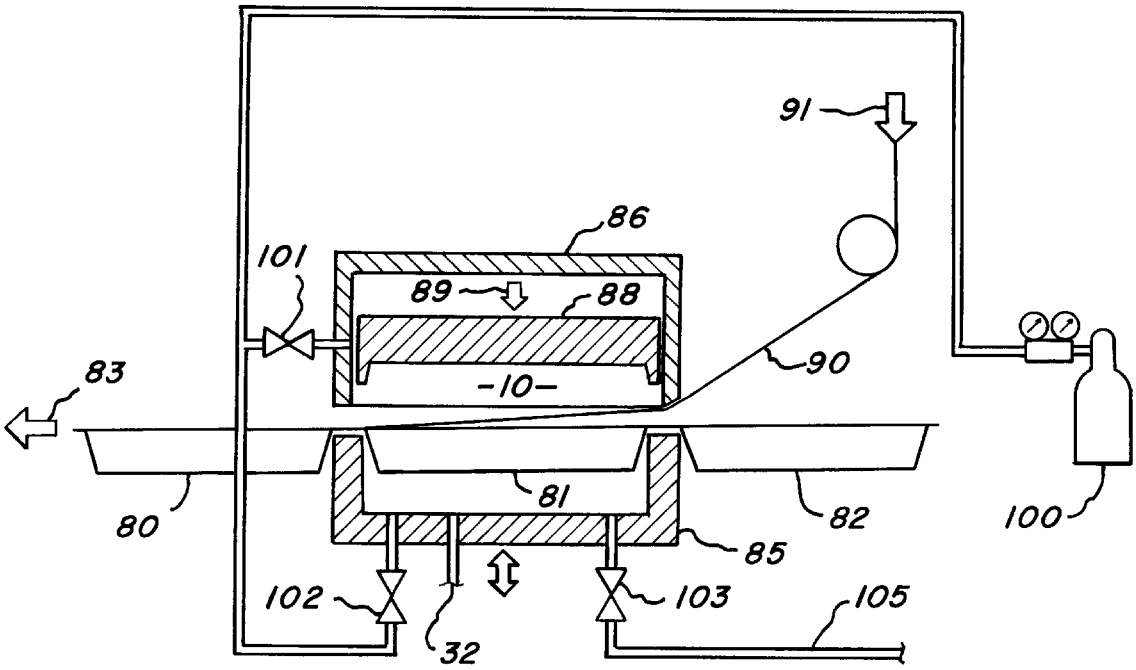
FIG. 2 shows a pictorial representation of the packaging machine product chamber.

Referring next to FIG. 2, a pictorial representation of the packaging machine and product chamber 10 is illustrated. In this example, a plurality of product packages 80, 81, 82 are moved through product chamber 10 in the direction illustrated by arrow 83. Each product package intermittently stops inside of product chamber 10 and a chamber wall 85 is moved upwardly to confine the product package inside chamber 10. This is illustrated in FIG. 2, wherein product package 81 is positioned inside chamber 10 and chamber wall 85 is shown in a position where it may be moved upwardly to clamp the product package 81 between housing 85 and housing 86. Once the package 81 has been clamped within product chamber 10, the sealing mechanism 88 is moved downwardly as indicated by the arrow 89 to completely seal the package with a cover film 90. Cover film 90 is dispensed from a film roll (not shown) along the direction indicated by arrow 91 to provide a continuous supply of film for covering the product packages as each package moves through the product chamber 10.

Prior to and during the product packaging operation, the gas content within product chamber 10 is controlled and monitored. A source of flushing gas 100, such as nitrogen gas, is coupled into the interior of product chamber 10 by means of valves 101, 102. The flushing gas is an inert gas which is intended to flush out any contaminant gases such as oxygen prior to the packaging operation. An opening 32 connects the interior of chamber 0 to sample valve 30, to enable sample valve 30 to pass gas from inside of product chamber 10 to sample chamber 50.

Figure 3:
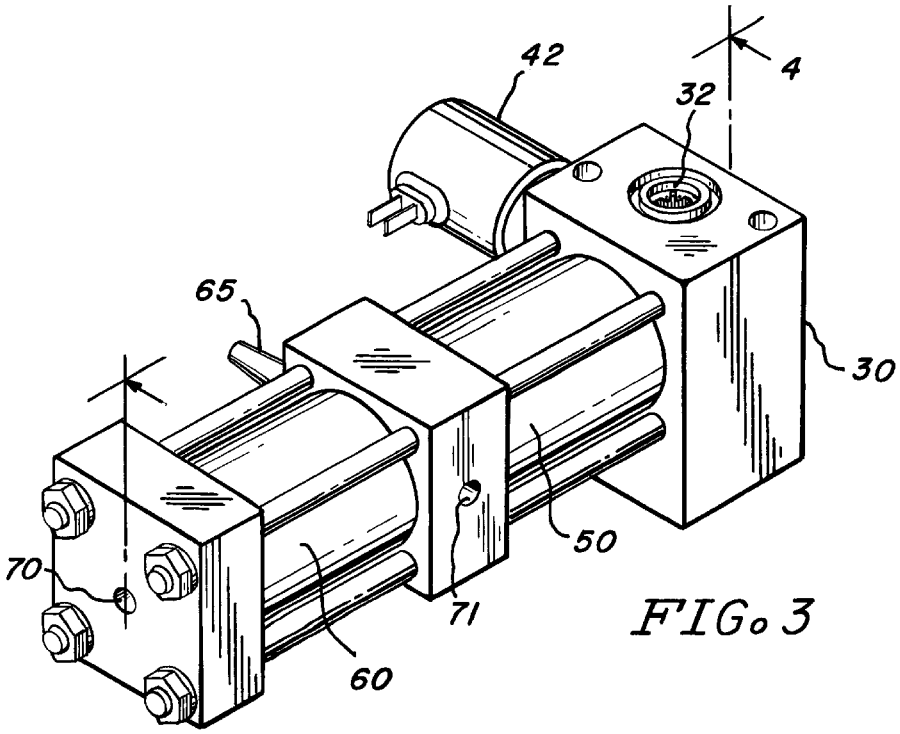
FIG. 3 shows an isometric view of the gas sampling valve and sample cylinder.

Referring to FIGS. 2 and 3, a preferred sequence of operation can be described. The sequence steps may vary somewhat, depending upon the particular product packaging machine which is selected, and depending upon the efficiency of operation of the product packaging machine. For example, in order to improve the efficiency of the operation and to lower the residual amount of contaminant gases remaining in a product chamber, the product chamber may be evacuated as a part of a flushing process. To evacuate the product chamber, valve 103 is opened to couple a vacuum line 105 to the product chamber. The resulting negative pressure in the product chamber will force out any contaminant gases trapped in the product or the package, where residual contaminant gases can be more easily removed by subsequent flushing operations. The sequence of operation for a typical Mahaffy & Harder product packaging machine comprises the following steps:

1) close the product chamber;
2) evacuate the product chamber;
3) flush the product chamber with an inert gas;
4) repeat the evacuation step 2;
5) repeat the product chamber flushing step 3; and
6) seal the package in the product chamber.

FIG. 3 shows an isometric view of the double-acting cylinder 60, sample chamber 50, sample valve 30 and solenoid 42. The cylinder 60 has an air line inlet 70 at one end and an air line inlet 71 at the other end. A vent 65 is coupled to the inside of the sample chamber 50. Sample valve 30 affixed at one end of cylinder 50 and the solenoid 42 projects outwardly from sample valve 30. A sample valve inlet 32 is connectable to product chamber 10.

Figure 4:
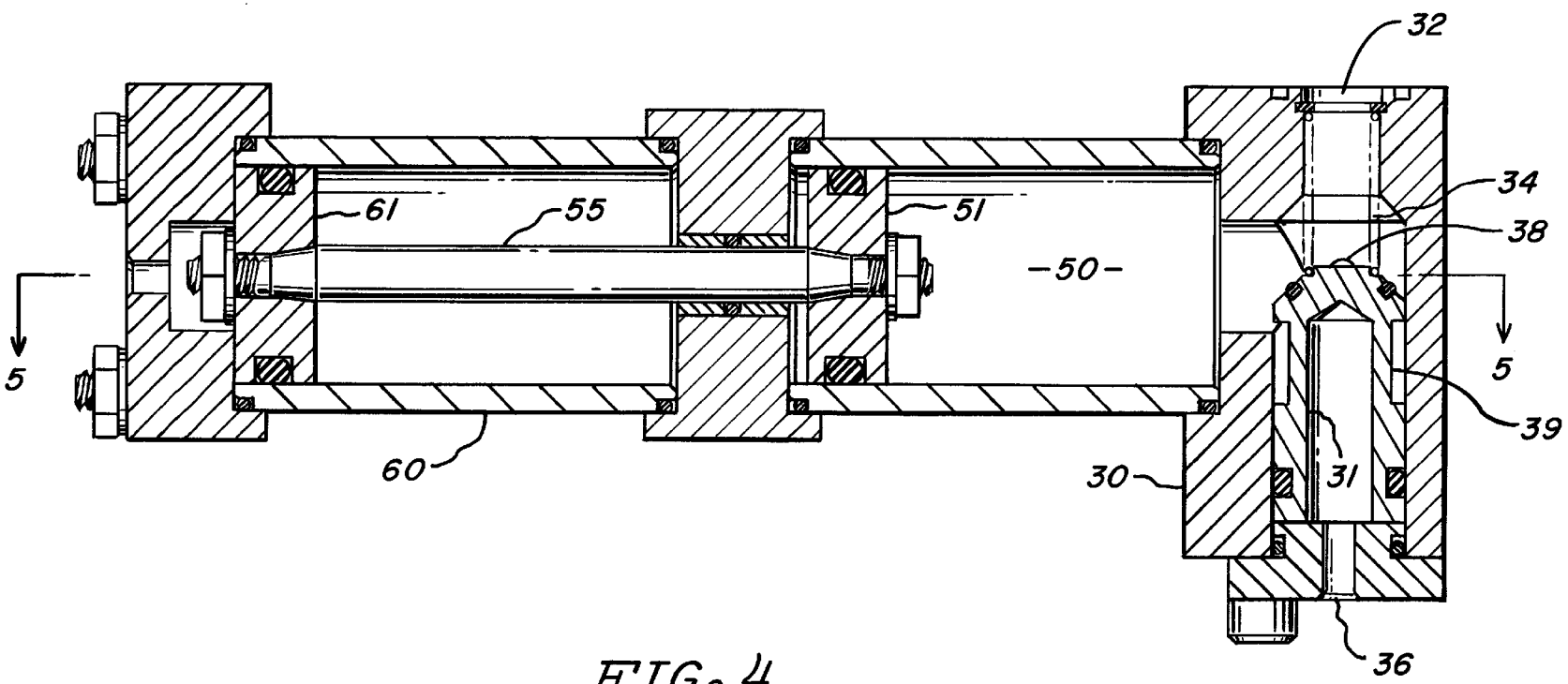
FIG. 4 shows a cross-section view taken along the lines 4—4 of FIG. 3.

FIG. 4 shows a cross-section view taken along the lines 4—4 of FIG. 3. The piston 61 is directly and mechanically connected to piston 51 by a piston rod 55. Therefore, any linear motion of piston 61 is translated into a corresponding linear motion of piston 51. The cylinder enclosing chamber 50 is connected directly into sample valve 30. The opening 32 at the end of sample valve 30 is coupled directly into the product chamber 10. Therefore, when piston 51 is positioned as shown, gas may pass into sample chamber 50 via opening 32. Sample valve 30 has a valve head 31 which is biased downwardly by a spring-biasing means 34; valve head 31 is moved upwardly by pressurized air entering into inlet 36, which is controlled by solenoid 35. In the upper, or closed position, valve head 31 is tightly sealed against opening 32 and, therefore, prevents the flow of gas therethrough. However, in this position an outlet 38 is opened into sample chamber 50 by virtue of an annular groove 39 which extends circumferentially around valve head 31. Outlet 38 is connectable to online gas analyzer 20. In the closed position, sample valve 30 therefore is positioned to convey the contents of sample chamber 50 into the on-line gas analyzer 20 when piston 51 is moved rightwardly.

Figure 5:
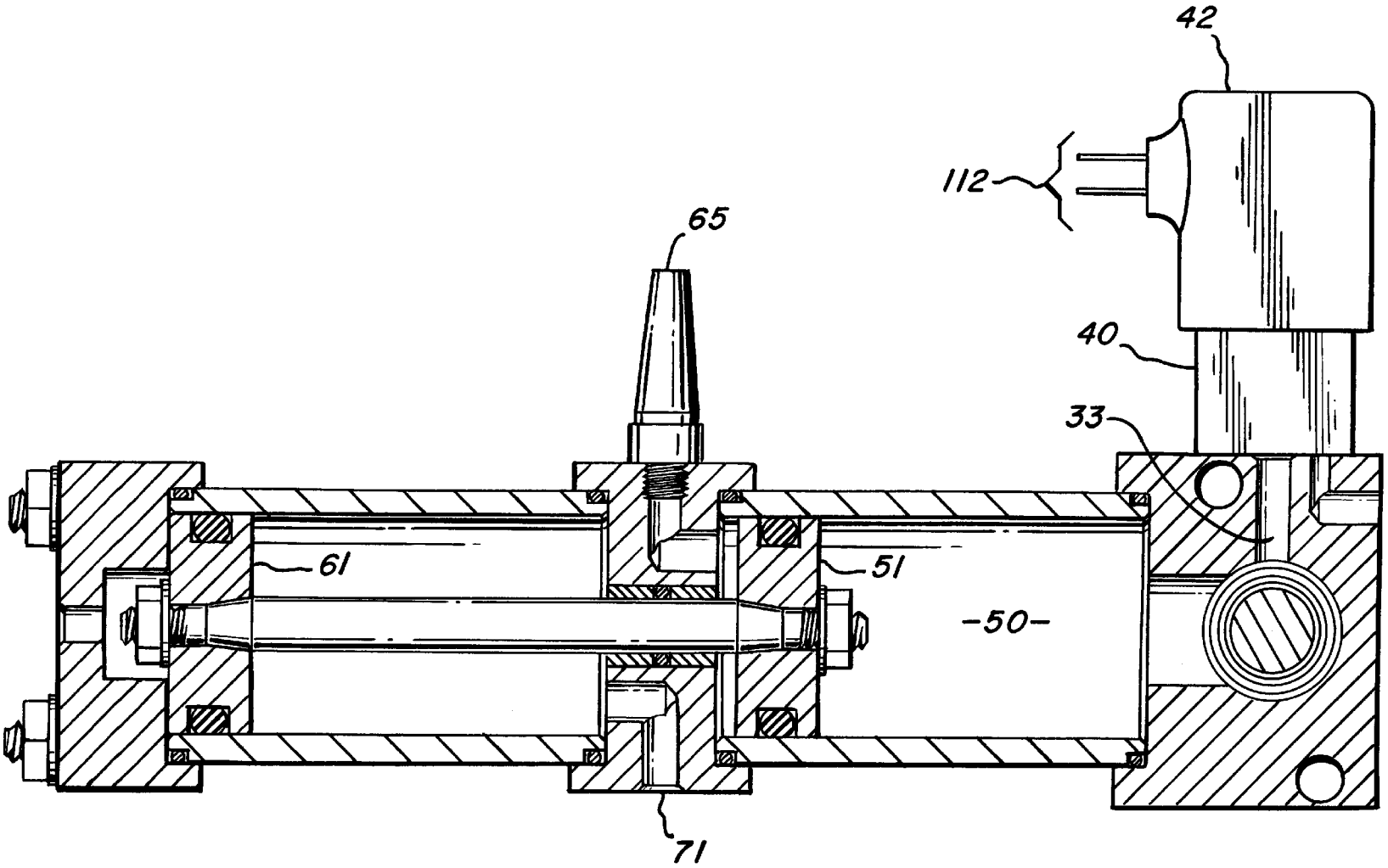
FIG. 5 shows a cross-section view taken along the lines 5—5 of FIG. 4.

FIG. 5 shows a view taken along the lines 5—5 of FIG. 4. In this view, the exhaust valve 40 is shown connected to sample valve 30, so as to control the flow of gas from passageway 38 to passageway 41. Passageway 41 is connected via a gas line to gas analyzer 20. Exhaust valve 40 is controlled by solenoid 42, which may be actuated by electrical signals on lines 112 as described earlier.

Figure 6:
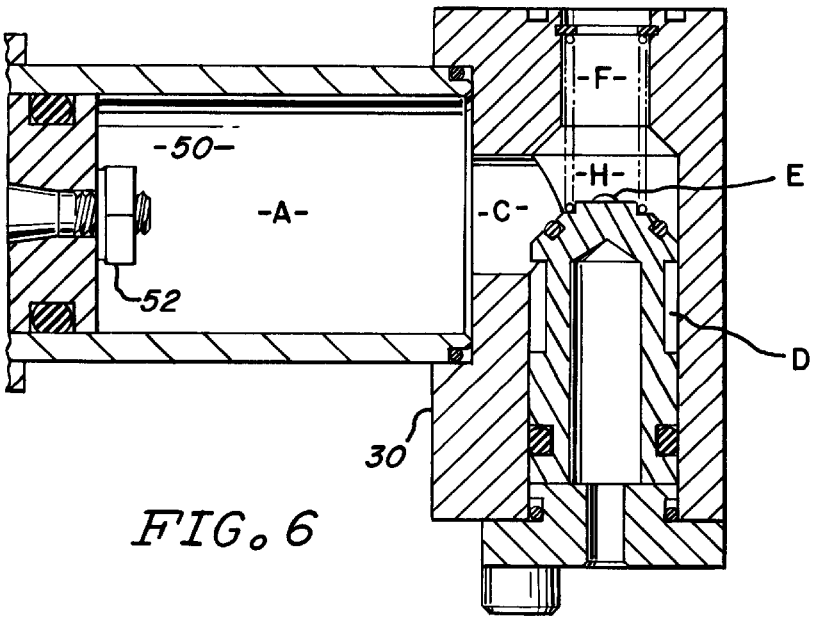
FIG. 6 shows the relationship between the critical volumes in the sampling apparatus.

FIG. 6 shows the relationship between critical volumes in the sampling chamber, the sampling valve, and the various flow paths. The volume of sample chamber 50 is designated "A"; the volume occupied by the piston nut 52 is designated "B"; therefore, the volume available for gas in sample chamber 50 is "A–B". The volume delivered to the gas analyzer must be at least 5 cc., which is the minimum required for the gas analyzer to perform, but other constraints require that the volume be larger than the minimum.

The volume of the outlet throat of sample valve 30 is designated "C"; the volume of the annular groove 39 about valve head 31 is designated "D"; the volume of the outlet passageways 38, 41, and the gas line to gas analyzer 20 is "E". Therefore, the volume of the internal space when the sample valve 30 is closed and the sample chamber is at minimum volume (called the "dead volume") is C+D+E. The "dead volume" should be kept as small as possible, relative to the sample chamber volume, so that very little gas can be trapped in the "dead volume" between operative cycles of the apparatus, to possibly contaminate the measurement of the next subsequent gas sample. During any given operational sequence, the initial gas sample occupying the "dead volume" is the sample remaining from the previous operational cycle; therefore, the new gas sample volume must be sufficient to completely fill this "dead volume" to purge the old gas sample from the system. In practice, we have found that a factor of 1½ to 2 should be used for accurate measurements; ie., the volume of the sample chamber should be at least 1½ to 2 times the minimum gas analyzer volume plus the "dead volume."

The volume of the inlet throat of sample valve 30 is designated "F"; the volume of the internal valve chamber is "H". Therefore, the entire gas volume from the product chamber to and including the sample chamber 50 is (A–B)+H+F, when the sample valve is open and connected to the product chamber. It is important that this volume be much smaller than the volume of the product chamber, in order not to influence the product chamber purging and filling cycles, and in order for the gas in the product chamber to be quickly transferred to the sample chamber. In practice, this is usually easy to achieve when volumes of (A–B)+H +F are selected to be on the order of 50 cc.'s or less.

In one representative embodiment we selected a sample valve and exhaust valve, connected to the gas analyzer via 10 feet of ⅛-inch copper tubing, having the following characteristics:

Volume C+D+E=8 cc.'s

Volume H+F=3 cc.'s

This led to the design of a sample chamber having a volume:

Volume A–B=21 cc.'s. Therefore, the sample chamber delivered 21 cc.'s of gas through the system, providing twice the volume for the "dead volume" plus the minimum 5 cc.'s needed for the gas analyzer, which yielded an accuracy exceeding 98% of the measured gas, and permitted an operational cycle of about 3 seconds. With this representative embodiment the system can sample gases in the packaging chamber for every second package which is sealed.

In operation, the method of this invention is practiced by operating the apparatus according to the following sequence of steps:

1) close the packaging machine product chamber and evacuate the gas from the chamber;
2) purge the packaging machine product chamber with a neutral gas;
3) re-inject neutral gas into the product chamber;
4) retrieve a sample of the gas remaining in the product chamber into the sample chamber;
5) activate the product package sealing mechanism;
6) close the sample valve and open the exhaust valve;
7) transfer the gas sample from the sample chamber to the on-line gas analyzer; and
8) obtain an electrical signal from the gas analyzer which is representative of the measured gas content.

The packaging machine controller is programmed to accomplish the foregoing steps in the proper sequence and to provide a signal indication of the oxygen content of the measured gas. Other features such as a failure alarm, a statistical analysis algorithm, a trend calculation, and other types of calculations may be conducted to provide an apparatus which may cumulatively respond to sequential gas measurements for the purpose of providing statistical analysis or trend indications.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A gas analyzer apparatus for connection to a packaging machine product chamber and packaging machine controller, comprising:

a) a sampling valve having a first internal volume, coupled to said product chamber;

b) a sample chamber having a second internal volume, connected to said sampling valve;

c) an exhaust valve having a third internal volume, connected to said sample chamber;

d) an on-line gas analyzer connected to said exhaust valve via passageways having a fourth internal volume, and wherein said gas analyzer requires a fifth gas volume for operation; and e) means for actuating said sample valve, said sample chamber, said exhaust valve and said on-line gas analyzer, for retrieving a gas sample from said product chamber into said sample chamber and for transferring said gas sample from said sample chamber to said on-line gas analyzer; wherein said second internal volume is greater than the sum of said first, third, fourth and fifth volumes.

2. The apparatus of claim 1, wherein said means for actuating further comprises a solenoid actuable by a signal from said packaging machine controller.

3. The apparatus of claim 2, wherein said sample chamber further comprises a reciprocable piston in a cylinder.

4. The apparatus of claim 3, wherein said means for actuating said sample chamber further comprises an air cylinder mechanically linked to said reciprocable piston, and an electric solenoid valve connected to said air cylinder, said solenoid valve having electrical connection to said packaging machine controller.

5. The apparatus of claim 4, wherein said second internal volume is greater than twice said first, third and fourth volumes, plus said fifth volume.

6. The apparatus of claim 5, wherein said exhaust valve further comprises an electric solenoid valve having passages connectable to said sample chamber and to said gas analyzer, and having electrical connection to said packaging machine controller.

7. An apparatus for retrieving and measuring gas samples from a product package confined within a packaging chamber, comprising:

a) a passageway into said packaging chamber, and a sample valve connected to said passageway;

b) a sample chamber connected to said sample valve, said sample chamber having a first internal volume and means for withdrawing a gas sample from said packaging chamber and means for expelling said gas sample from said sample chamber through an outlet passage having a second internal volume;

c) an exhaust valve having a third internal volume, connected to said outlet passage; and d) a gas analyzer connected to said exhaust valve via passages having a fourth internal volume, said gas analyzer having means for measuring the oxygen content of a gas volume comprising a fifth minimum volume, conveyed via said exhaust valve; whereby said first volume is at least 1½ times the sum of said second, third and fourth volumes, plus said fifth minimum volume.

8. The apparatus of claim 7, wherein said sample chamber means for retrieving and expelling a gas sample further comprises a cylinder having a reciprocable piston therein, the interior volume of said cylinder comprising said sample chamber.

9. The apparatus of claim 8, wherein said sample chamber means for retrieving and expelling a gas sample further comprises an air cylinder having a piston rod attached to said sample chamber reciprocable piston, and air valve means for conveying pressurized air to said air cylinder.

10. The apparatus of claim 9, wherein said air valve means further comprises a solenoid valve having air passages connected to a source of pressurized air, said solenoid valve being actuable by an electric signal into either of two operable positions.

11. A method for analyzing gas content in a package prepared and sealed in a packaging machine product chamber, comprising the steps of:

a) closing the product chamber and evacuating most of the gas from the chamber;

b) purging the product chamber with a neutral gas;

c) retrieving a volume sample of the gas remaining in the product chamber into a sample chamber;

d) sealing the package in the product chamber;

e) transferring a portion of the volume gas sample from the sample chamber to a gas analyzer, whereby the gas volume sample comprises a volume greater than twice the volume transferred to the gas analyzer; and f) obtaining an electrical signal from the gas analyzer which is representative of the gas content in the gas sample.

12. The method of claim 11, wherein the step of transferring a volume sample of the gas further comprises transferring by the stroke of a piston in a cylinder, the cylinder comprising the sample chamber.

* * * * *